US005958643A

United States Patent [19]

Fujiwara et al.

[11] Patent Number: 5,958,643

[45] **Date of Patent: *Sep. 28, 1999**

[54] LIQUID DEVELOPER HAVING POLYMER PARTICLES OF A FLAT CONFIGURATION DISPERSED IN A DISPERSION MEDIUM

[75] Inventors: Toshimitsu Fujiwara, Kobe; Shuji Iino, Muko; Hidetoshi Miyamoto, Takatsuki, all of Japan

[73] Assignee: Minolta Co., Ltd., Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/693,370

[22] Filed: Aug. 6, 1996

Related U.S. Application Data

[63] Continuation of application No. 08/308,516, Sep. 21, 1994, abandoned.

[30] Foreign Application Priority Data

Sep. 22, 1993 [JP] Japan ..... 5-259458

[51] Int. Cl.[6] ..... G03G 9/13

[52] U.S. Cl. ..... 430/114; 430/112; 430/115; 430/137

[58] Field of Search ..... 430/115, 114, 430/112, 137, 904, 111

[56] References Cited

U.S. PATENT DOCUMENTS

| | | | |
|---|---|---|---|
| 4,032,463 | 6/1977 | Kawanishi et al. | 430/114 |
| 4,473,629 | 9/1984 | Herrmann et al. | 430/114 |
| 4,794,651 | 12/1988 | Landa et al. | 430/110 |
| 4,874,683 | 10/1989 | Shirai et al. | 430/114 |
| 4,923,778 | 5/1990 | Blair et al. | 430/137 |
| 5,270,445 | 12/1993 | Hou | 430/137 |
| 5,328,795 | 7/1994 | Yamashiro et al. | 430/137 |
| 5,403,693 | 4/1995 | Patel et al. | 430/137 |

FOREIGN PATENT DOCUMENTS

| | | | |
|---|---|---|---|
| 0524016 | 1/1993 | European Pat. Off. | 430/137 |

OTHER PUBLICATIONS

U.S. application No. 08/308,525, Fujiwara et al., filed Sep. 19, 1994.

*Primary Examiner*—Janis L. Dote
*Attorney, Agent, or Firm*—McDermott, Will & Emery

[57] ABSTRACT

A liquid developer having polymer particles dispersed in a dispersion medium, wherein the polymer particles have a mean volume particle size $d_{50}$ of 0.5~5.0 $\mu$m, and degree of flatness (longest diameter of a single particle/shortest diameter of a single particle) is greater than 1.5 but less than 30.

21 Claims, 4 Drawing Sheets

LIQUID DEVELOPER HAVING POLYMER PARTICLES OF A FLAT CONFIGURATION DISPERSED IN A DISPERSION MEDIUM

This is a continuation of application Ser. No. 08/308,516 filed Sep. 21, 1994, now abandoned.

BACKGROUND OF THE INVENTION

1. Field of the Invention

The present invention relates to a liquid developer for developing electrostatic latent images formed on the surface of a latent image carrying member, said liquid developer comprising a dispersion of specific polymer particles in a dispersion medium.

2. Description of the Related Art

Electrophotographic methods can be broadly divided into dry process developing methods and wet process developing methods. Among these methods, developing methods of the wet process type use toner dispersed in a fluid, and a toner particle diameter to the submicron range can be achieved. Having a toner particle diameter in this range is advantageous inasmuch as it produces high resolution with excellent halftone qualities, and readily allows fixing of the toner image.

In conventional developing processes of the wet process type using toner particles in the submicron range require a high electric field to achieve each electrostatic transfer, thus making said transfer difficult due to excessive charge of the toner. As the toner particle diameter becomes smaller, there is less movement of the toner in the fluid, resulting in the disadvantage of slower developing speed which makes it unsuitable for high-speed applications.

Liquid developers using relatively large size polymer particles as the toner particles so as to eliminate the aforesaid disadvantages are subject to loss of dispersion stability, and polymer particle sedimentation.

In general, there are various theoretical equations which express particle sedimentation rates, but the best known is the Stokes equation. Actually, the sedimentation of particles in a fluid is dependent on various factors such as particle shape, charge and the like, but when assuming the sedimentation of spherical particles in an infinite Newtonian fluid influenced by gravity alone, the particle sedimentation rate is expressed by Equation 1 below.

$$V=218r^2(P_s-P)/\eta \quad (1)$$

where the following values obtain:

V: particle sedimentation rate r: particle size $P_s$: particle density

P: solvent density

η: solvent viscosity

As can be understood from the above equation, in general, the larger the particle size, the greater the sedimentation rate and the more readily sedimentation occurs. Thus, using large size toner in a liquid developer can be said to be advantageous inasmuch as developing speed and transfer efficiency are improved, while also being disadvantageous insofar as long-term stability and storage characteristics are adversely affected.

When particles settle, the liquid developer density changes so as to adversely affect the image and cause an erroneous warning that it is time to replenish the toner, i.e., of the existence of a "toner empty" condition. Although this situation may not occur if the liquid developer is restored to its original state by a simple mixing mechanism when a slight amount of particles settle, the practicality of such a solution is reduced when a large scale mixing mechanism or resupply mechanism is required to simply re-disperse the settled particles.

SUMMARY OF THE INVENTION

An object of the present invention is to provide a liquid developer which improves developing speed and transfer characteristics without loss of high resolution, and which does not readily have polymer particle sedimentation during long-term storage such that developer characteristics do not readily vary.

The aforesaid object of the present invention is achieved by changing the toner configuration from spherical to flat and increasing the resistance coefficient Cs described later.

The aforesaid resistance coefficient Cs is a value expressing the magnitude of resistance imparted to the particle from the fluid, and affects the particle sedimentation rate. This value is a function of the Reynold's number. Various research has been reported on this subject, such as Wadell's method which defines the degree of particle sphericity Ψ by Equation 2 below.

$$\Psi=(\text{surface area of spheres of identical volume})/(\text{surface area of actual particles}) \quad (2)$$

As the degree of sphericity becomes smaller, i.e., as the surface area of the true spherical particles increases as they become irregular in shape, the resistance coefficient Cs of the particles is expressed as a large value. This phenomenon reduces the sedimentation rate to the degree that the shape of the particles departs from the truly spherical.

In the present invention, polymer particles having a flat configuration are used to improve dispersion characteristics by increasing the surface area via said deformation, and increasing resistance relative to gravity in consideration of said configuration.

That is, the previously described objects of the present invention are achieved by providing a liquid developer comprising at least polymer particles which are preferably colored, dispersed in a dispersion fluid, wherein said polymer particles have a mean volume particle size $d_{50}$ of 0.5~5.0 μm, and the degree of flatness (longest diameter of a single particle/shortest diameter of a single particle) is greater than 1.5 but less than 30. In one embodiment, the flat configuration polymer particles have a mean volume particle size $d_{50}$ of 0.5~3 μm.

DETAILED DESCRIPTION OF THE INVENTION

Figure 1:
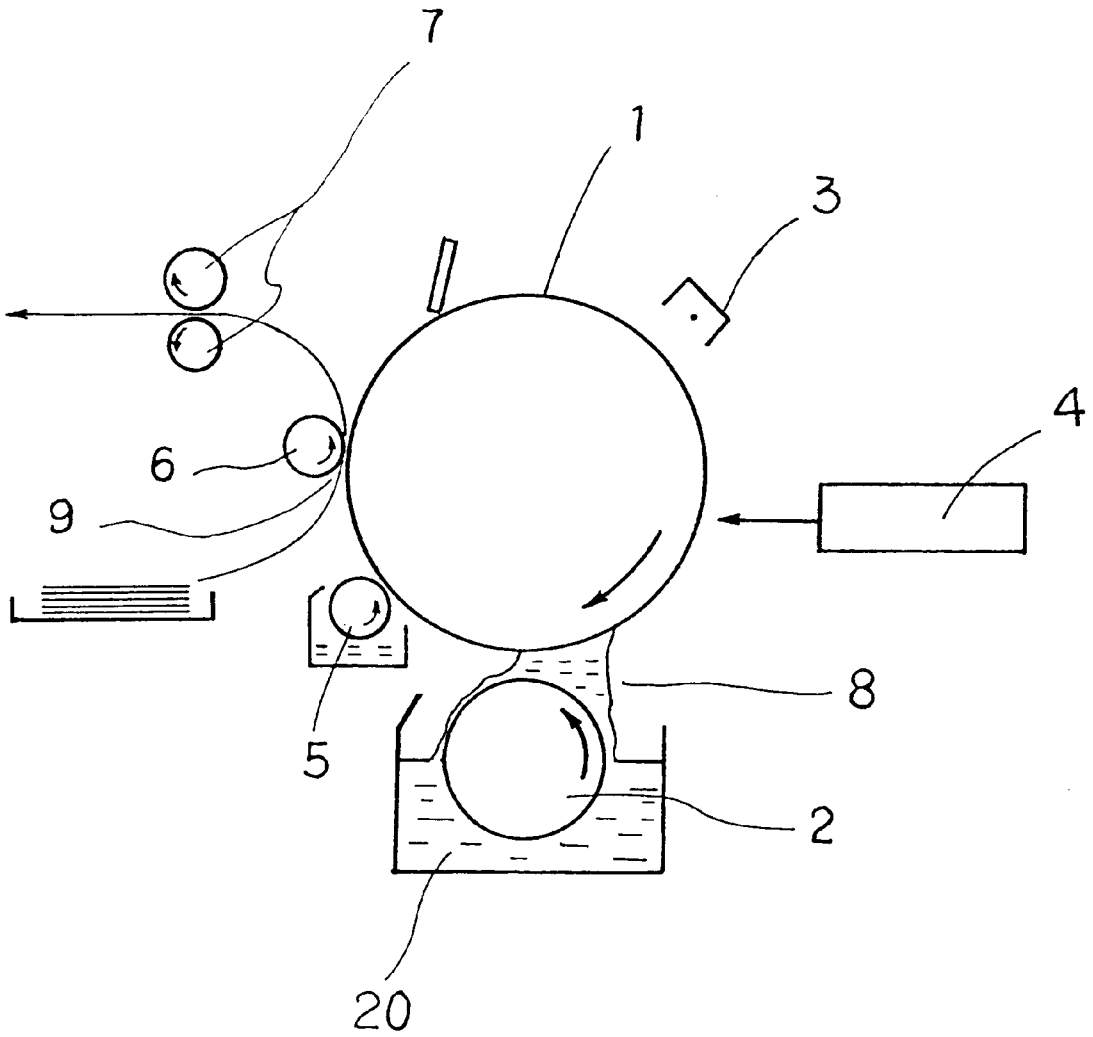
FIG. 1 is an illustration showing an image forming apparatus for forming images using the liquid developer of the present invention.

The present invention is a liquid developer having polymer particles of a flat configuration dispersed in a dispersion medium, said polymer particles which are preferably colored, further having a specific mean volume particle size.

When the mean volume particle size of the resolution images cannot be obtained, whereas when the mean volume particle size of said polymer particles is less than 0.5 μm, the charge of the particles themselves becomes too high, thereby adversely affecting transfer characteristics. Even when the mean volume particle size of the polymer particles is within the aforesaid range, if the degree of flatness is greater than 30, the polymer particles are pulverized during the image forming operation, thereby producing particle size irregularities. On the other hand, polymer particles having a degree of flatness less than 1.5 do not have an adequate resistance coefficient Cs, such that said polymer particles are readily susceptible to sedimentation in a liquid developer, thereby causing changes in the density of the liquid developer over long-term use.

Accordingly, the previously described objects are achieved by providing a liquid developer of the present invention which uses as the polymer particles dispersed in a dispersion medium particles having a mean volume particles size $d_{50}$ of 0.5~5.0 μm and a flat configuration having a degree of flatness greater than 1.5 and less than 30.

The liquid developer of the present invention is described hereinafter.

The liquid developer of the present invention, as previously described, comprises at least a dispersion of polymer particles having a specific mean volume particle size and specific particle size distribution dispersed in a dispersion medium.

The polymer particles used in the present invention may be resin particles incorporating additives such as pigments, charge regulators, waxes and the like as required, and may be manufactured by selecting suitable conventional methods depending on resin constituents, desired particle size, and shape. Examples of useful manufacturing methods include wet process manufacturing methods such as suspension polymerization, emulsion polymerization, nonaqueous dispersion polymerization, emulsion dispersion granulation, sheet polymerization and the like, and dry process manufacturing methods such as spray drying, pulverization and the like, but from the perspective of obtaining a high yield of uniformly spherical resin particles a wet process manufacturing method or spray drying process manufacturing method is desirable. Among wet process manufacturing methods, it is desirable to use polymer particles obtained by an emulsion dispersion granulation method from the perspectives of the selection of usable types of resins, ease of molecular weight adjustment, resin blending characteristics, and sharpness of the particle size distribution curve.

Emulsion dispersion granulation methods make polymer particles by following steps.

The first step is preparing polymer solution by dissolving polymer in non-water soluble organic solvent. The second step is forming an emulsion of the oil-in-water (O/W) type by dispersing the polymer solution in an aqueous dispersion solution. The third step is depositing the polymer particles by heating the O/W type emulsion while mixing so as to evaporate the organic solvent. Thus, the polymer particles are obtained by a relatively simple operation via a simplified process. Accordingly, production efficiency is improved and costs are reduced. Another advantage is that, compared to pulverization methods, the particle size distribution curve is sharp, and a broad variety of resins can be used.

Polymer particles comprising resin (100 parts by weight) and pigments used for coloring (5~20 parts by weight) are well dispersed in a non-water soluble organic solvent (300~1,000 parts by weight). At this time, carbon black, phthalocyanine or like pigment may be used as a coloring agent, but usable coloring agents are not limited to the aforesaid examples inasmuch as stains or colored resins may be used.

If the resin used to form the polymer particles is dissolvable in a non-water soluble organic solvent, there is no limitation placed on the type of usable resin. For example, polyester resin, styrene-acrylic copolymer, polystyrene, polyvinyl chloride, polyvinyl acetate, polymethacrylate ester, polyester polyacrylic ester, epoxy resin, polyethylene, polyurethane, polyamide, paraffin wax and the like are resins that may be used individually or in mixtures of two or more types.

Liquid developing methods do not triboelectrically charge the chargeable materials, i.e., toner particles (polymer particles) and carrier particles, as in dry process developing methods, such that resin characteristics need not be selected in consideration of spent toner or fusion characteristics. Therefore, in the liquid developer of the present invention, a low melting point resin may be used so as to reduce the amount of heat required for fixing.

The previously mentioned non-water soluble organic solvent may be a solvent capable of dissolving a polymer while being insoluble in water. In particular, a solvent having a boiling point greater than 0° C. and less than 50° C. may be used. Examples if useful solvents are methylene chloride, diethyl ether, acetone, toluene, methyl acetate and the like, although the invention is not specifically limited to said solvents.

The obtained resin solution is dispersed in an aqueous dispersion solution using a mixer having a high shearing force. Although an aqueous dispersion solution may be suitable selected, water, or suitable amounts of methyl alcohol or ethyl alcohol may be added, water is particularly desirable. When water is used, the resin solution (30~100 parts by weight) may be dispersed in water (100 parts by weight) together with a dispersion stabilizer or dispersion stability enhancer (1~5 parts by weight). Specifically, an emulsion of the O/W type is obtained by mixing at a speed corresponding to the desired particle size using a Homomixer or the like. In general, the greater the mixing speed, the smaller the particle size, and the longer the mixing time, the sharper the particle size distribution. Therefore, the mixing speed, mixing time and like factors may be suitably adjusted, so as to obtain polymer particles having a mean volume particle size $d_{50}$ of 0.5~5.0 μm. As to the polymer particles used in the liquid developer of the present invention, 80% of the total volume of the polymer particles is present preferably within a range of $d_{50}\pm1$ μm, and more preferably $d_{50}\pm0.5$ μm.

The mean volume particle size $d_{50}$ and particle size distribution of the present invention were measured using a model SALD-1100 manufactured by Shimadzu Seisakusho, Ltd.

The previously mentioned dispersion stabilizer is preferably a hydrophilic cheloid in an aqueous dispersion fluid, useful examples of which include gelatins, gum arabic, agar-agar, cellulose derivative (e.g., hydroxymethyl cellulose, hydroxypropyl cellulose), synthetic polymer (e.g., polyvinyl alcohol, polyvinyl pyrrolidone, polyacrylate, polymethacrylate).

A normal surface-active agent is used as the previously mentioned dispersion stabilization enhancing agent, examples of which include natural surface-active agents such as saponine, nonionic surface-active agents such as alkylene oxide, glycerine, or glycidol, and anionic surface-active agents incorporating an alkali-reactive group such as carboxylic acid, sulfonic acid, phosphoric acid, sulfamate group, and phosphoric ester group.

It is particularly desirable to combine dispersion stabilizers and dispersion stabilization enhancing agents such a cellulose derivative (methylcellulose derivative) and a anionic surface-active agent (sodium dodecylbenzenesulfonate) or polyvinylalcohol and an anionic surface-active agent.

Then, in order to remove the organic solvent contained in droplets dispersed in the aqueous dispersion fluid, the temperature of the entire system is slowly elevated, so as to evaporate the organic solvent contained in the droplets while mixing. Thereafter, particles are removed from the emulsion via a separation process such as filtration or centrifugation or the like, and after a washing process if such is required, said particles are dried to obtain the desired polymer particles.

The shape of the polymer particles obtained by the previously described emulsion dispersion granulation method is spherical with a smooth surface. The polymer particles can be deformed to a flat shape without distorting the mean volume particle size, as described later. However, in the wet process developing methods such as the method of the present invention, it is possible to use spherical particles as the developer.

On the other hand, polymer particles having a relatively narrow particle size distribution can be obtained by a spray drying process. Such a spray drying process is described hereinafter.

Just as in the previously described emulsion dispersion granulation method, a polymer is dissolved in an organic solvent to adjust the resin solution. After the coloring agents such as pigments are adequately dispersed in the obtained resin solution and said dispersion fluid is sprayed from a nozzle, the spray is heated to evaporate the organic solvent, so as to thereby obtain the desired polymer particles.

Usable solvents, polymers, and coloring agents may be identical to those used in the emulsion dispersion granulation process. If there is a high concentration of the resin dissolved in the solvent, the particle size of the produced resin particles is larger, and the effectiveness of the present invention cannot be achieved, whereas if the particle size is too small, the yield is adversely affected, such that the resin concentration is desirably 1~30 percent by weight, and preferably 1.5~15 percent by weight. The spray drying method provides for a broad selection of polymers and solvents just as does the emulsion dispersion granulation method, and examples of usable solvents include, in addition to those previously described, water-soluble solvents such as tetrahydrofuran (THF) and the like. Viscosity and boiling temperature and the like can be regulated by combining two or more of the aforesaid materials.

The spray drying method can be accomplished using a spray drying machine such as Dispacoat (Nissin Engineering, K.K.) or the like. The previously described resin solution is sprayed into a drying chamber by a high-speed airflow, and is dried by means of heated air blown from the bottom of the chamber to as to produce the resin particles. Resin particles lifted to the peripheral portion of the chamber may be collected in a collecting bottle or the like so as to obtain the desired polymer particles.

In spray drying methods, the particle size of the obtained polymer particles can be readily adjusted by adjusting various conditions such as resin solution concentration, spray pre ssure and the like. This method is advantageous inasmuch as resin particles completely lacking impurities are obtained and processing is shorter because the resin particles do not require washing because surface-active agents are not used.

The polymer particles obtained by the previously described method may have additives added thereto such as common charge control agents, dispersion enhancers, dispersion stabilizers, resins and the like. The aforesaid additives may be dispersed in the liquid medium (dispersion medium) using an ultrasonic dispersion device so as to regulate the liquid developer. This developer can be used directly as the developer, but to improve dispersion of the polymer particles and provide a liquid developer that is not subject to easy sedimentation of the polymer particles, said polymer particles are subjected to an additional process to change their configuration to a flat shape.

In general, an electrically insulative organic material is used as the dispersion medium. Examples of useful dispersion media are aliphatic hydrocarbons, alicyclic hydrocarbons, aromatic hydrocarbons, halogenated hydrocarbons, polysiloxane and the like, and from the perspectives of nontoxicity, odor, and cost, isoparaffin hydrocarbons are preferable. Specific examples are Isopar-G, Isopar-H, Isopar-L, Isopar-K (Exxon Corp.), Shelzole-71 (Shell Oil Co.), IP solvent 1620, IP solvent 2028 (Shukko Sekiyu Kagaku K.K.). Japanese Patent Application No. SHO51-19988 discloses a developing method using a water-base developer. In this method, an electrically insulative material need not be used as the dispersion medium; a low-resistance medium such as water may be used.

From the perspectives of developing speed, image fogging and the like, the polymer particle concentration in the dispersion medium is desirably 0.5~50 percent by weight, and preferably 2~10 percent by weight. The aforesaid concentration is the concentration during developing, and may be a greater concentration than the concentration during storage, replenishment, shipment or the like. The material used as the dispersion medium may be a liquid during developing, but need not be a liquid at room temperature. Accordingly, in the present invention, a wax or paraffin which is a solid at room temperature is usable as the dispersion medium.

Charge control agents which are charge-regulating agents or charge ehnhancing agents may be added to the dispersion medium for imparting an electrical charge of various polarities A common charge-regulating agent may be used. Examples of useful charge-regulating agents for imparting a positive polarity charge to the developer are metal salts of fatty acids such as stearic acid, metal salts of sulfosuccinate, metal salts of organic acids such as metal salts of abietic acid, or soluble polymers such as alkyd resins. Examples of useful charge-regulating agents for imparting a negative polarity charge to the developer are surface-active agents such as lecithin and the like, nitrogen compounds, or soluble polymers such as polyamide resins that adhere to the particles.

The amount of added charge control agents is desirably 0.0001~10 percent by weight relative to the dispersion medium, and preferably 0.001~3 percent by weight relative to the dispersion medium.

Charge enhancing agents may also be added to the dispersion medium in the same amount as the charge-regulating agent, e.g., $SiO_2$, $Al_2O_3$, $TiO_2$, ZnO and the like. various types of surface-active agents and soluble polymers may be added as agents which are dispersion enhancing agents or dispersion stabilizers in order to stabilize the dispersion of the particles in the liquid developer. Examples of the useful soluble polymers are polyolefin petroleum resins, linseed oil, polyalkylmethacrylate and the like. The soluble polymer comprising monomers having a polar group such as methacrylic acid, acrylic acid, alkylaminoethylmethacrylate and the like, may be added to the dispersion medium in order to increase the affinity between the polymer particles and the dispersion medium.

The amount in which the aforesaid agents are added may be such that they do not cause particle coagulation or hinder usability, nor is the amount prescribed as a rule by differences in type. When the amount of the agents is too small, the dispersion effect is reduced so as to cause particle coagulation, whereas when the agents' amount is too large, movement of the particles becomes difficult, thereby markedly reducing developing speed. Accordingly, the amount of the agents relative to the dispersion medium is desirably 0.01~20 percent by weight, and preferably 0.1~10 percent by weight.

Deformation from a spherical configuration to a flat configuration, with a degree of flatness greater than 1.5 and less than 30, occurs via the stress exerted on the polymer particles within the dispersion medium. This stress can be achieved by adding to the liquid developer in which is dispersed the polymer particles an identical volume of a medium such as glass beads, sand beads, zirconia beads, resin beads, resin-coated ferrite beads or the like, and mixing the liquid developer.

When the aforesaid type of medium is used, the bead diameter D should satisfy the following relationship relative to the mean volume particle size $d_{50}$ of the polymer particles.

$100<D/d<2{,}000$ and preferably $200<D/d<1{,}000$

When the aforesaid relationship is not satisfied, i.e., when D/d is less than 100, sufficient stress cannot be exerted on the polymer particles, whereas when D/d is greater than 2,000, it is exceptionally difficult to exert stress uniformly on the polymer particles, thereby causing wide variation in the thickness of the obtained flat particles. The specific gravity of the aforesaid medium is preferably a value about 1.0~5.0.

Although mixing may be accomplished at temperatures to a degree that the structural resin of the polymer particles is not finely pulverized, it is preferable that said mixing be accomplished near the glass transition point of the resin.

The polymer particles can be deformed to a flat shape without damage thereto by mixing with the previously described medium near the glass transition point. Polymer particles can be obtained which have a degree of flatness (longest particle diameter/shortest particle diameter) which is desirably 1.5~30, and preferably 20~30.

Equipment capable of accomplishing the aforesaid mixing includes, for example, the Sand Mill and Eiger Motor Mill. Simple mixing methods accomplish mixing by introducing into a sealed chamber the aforesaid medium and an electrophotographic liquid developer having dispersed therein granular coloring particles dispersed in an electrically insulative fluid medium, and mixing said materials by rolling via a ball frame, or mixing via turbine blades.

When strict control of the shape of the polymer particles is desired, after the aforesaid deformation process, the liquid developer may be processed by heating to a temperature near the glass transition point of the structural resin of the polymer particles so as to thermally restore the particle to a spherical shape without exerting stress on said polymer particles. By controlling the degree of the aforesaid thermal restoration the polymer particles can be regulated from the prethermal restoration flat shape to shapes of optional gradations.

When the glass transition point of the structural resin was measured by thermal analyzer device (e.g., DSC), it was found that a single peak expressed a temperature at which a peak was observable, a shoulder expressed a temperature of the maximum peak, and a double peak expressed an intermediate temperature between peaks. In the present invention, "near the glass transition point" is desirably within the range of ±20° C. of the glass transition point, and preferably within the range of ±10° C. of the glass transition point.

When the liquid developer is manufactured using the polymer particles obtained as described above, a liquid developer can be obtained wherein developing speed and transfer characteristics are improved due to the increased size of the particles, dispersion is excellent with only slight sedimentation of particles, and developer density and characteristics are constant.

DESCRIPTION OF THE PREFERRED EMBODIMENTS

Specific examples of the present invention are described hereinafter. In the following description, "parts" refers to "parts by weight" unless otherwise defined, and "$d_{50}$" refers to "mean particle size."

EXAMPLE 1

One hundred parts of low-molecular weight polyester resin (Mw: 15,000; Mn: 6,000; Tg: 53° C.) were completely dissolved in methylene chloride so as to achieve 20 percent by weight. An Eiger Motor Mill (Eiger Japan K.K.) was used to disperse 6 parts phthalocyanine as a coloring agent in the aforesaid resin solution.

The obtained resin solution was emulsified in an aqueous dispersion fluid of 1% Methlose 65SH-50 (Shin-Etsu Chemical Co., Ltd.) and 1% sodium lauryl sulfate at room temperature for 30 minutes at 8,000 rpm using a Homomixer (Tokusyu Kika Kogyo K.K.), to produce an emulsion of the O/W type. Then, a four-bladed mixing blade was installed and the methylene chloride was removed by evaporation while mixing for 3 hours at 40~45° C., so as to obtain an aqueous suspension of toner polymer particles having a $d_{50}$ of 2 $\mu$m.

The aqueous suspension of toner polymer particles was centrifuged to remove the solids, which were then thoroughly washed with water, filtered, and dried, so as to obtain toner polymer particles having a $d_{50}$ of 2 $\mu$m. Three parts polymer particles were added to 100 parts electrically insulative isoparaffin solvent IP Solvent 1620 (Shukko Sekiyu Kagaku K.K.). To this material were also added 3 parts lauryl methacrylate-methacrylic acid copolymer (lauryl methacrylate/methacrylate=95/5), and 0.5 parts dihydro aluminum abietate, and the solutions were subjected to mixing/dispersion for 20 minutes using an ultrasonic dispersion device so as to produce a liquid developer.

The obtained liquid developer was forcibly mixed with an equal volume of glass beads (diameter 1.0 mm), so as to deform the polymer particles dispersed in the liquid developer to a flat configuration.

Figure 2:
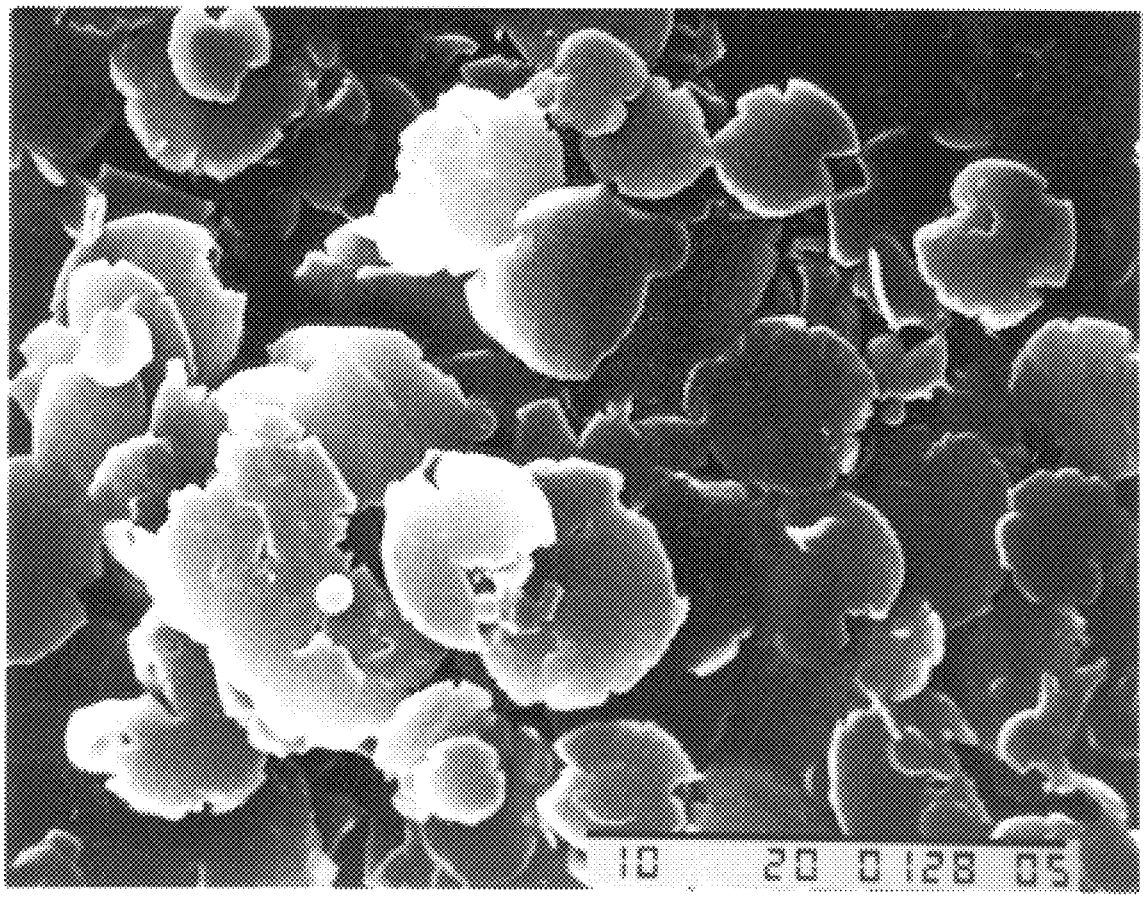
FIG. 2 is a photograph showing the structure of the polymer particle used in the liquid developer of the present invention.

FIG. 2 is a photograph showing the polymer particles obtained by this method.

EXAMPLE 2

The liquid developer obtained in Example 1 using the flat polymer particles (glass transition point 53° C.) as a toner was mixed via mixing blades for 3 minutes at 50° C., so as to obtain a liquid developer wherein the particles were thermally restored to a relatively spherical condition.

Figure 3:
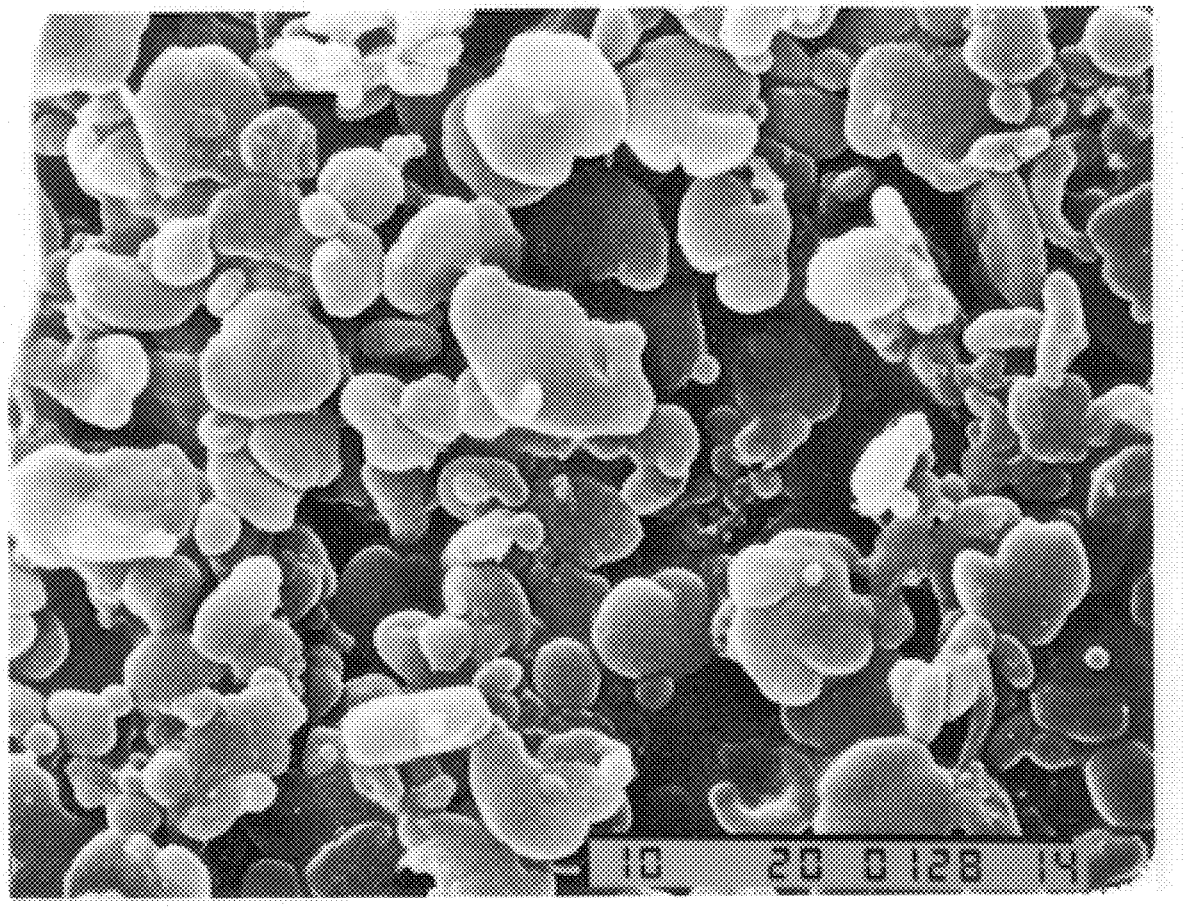
FIG. 3 is a photograph showing the construction of another polymer particle used in the liquid developer of the present invention.

FIG. 3 is a photograph showing the polymer particles obtained by this method.

EXAMPLE 3

The liquid developer obtained in Example 1 using the flat polymer particles (glass transition point 53° C.) as a toner was mixed via mixing blades for 5 minutes at 50° C., so as to obtain a liquid developer wherein the particles were thermally restored to a relatively spherical condition.

EXAMPLE 4

The liquid developer was prepared by the same method as used in Example 1 with the exception that the Homomixer was operated at 12,000 rpm.

The obtained liquid developer was forcibly mixed with an equal volume of glass beads (diameter: 0.5 mm), so as to deform the polymer particles dispersed in the developer to a flat configuration.

EXAMPLE 5

The liquid developer was prepared by the same method as used in Example 1 with the exception that the Homomixer was operated at 5,000 rpm.

The obtained liquid developer was forcibly mixed with an equal volume of glass beads (diameter: 1.0 mm), so as to deform the polymer particles dispersed in the developer to a flat configuration.

Comparative Example 1

The liquid developer using flat polymer particles as a toner obtained in Example 1 was mixed by mixing blades for 15 minutes at 50° C., so as to thermally restore the particles to a near spherical shape.

Figure 4:
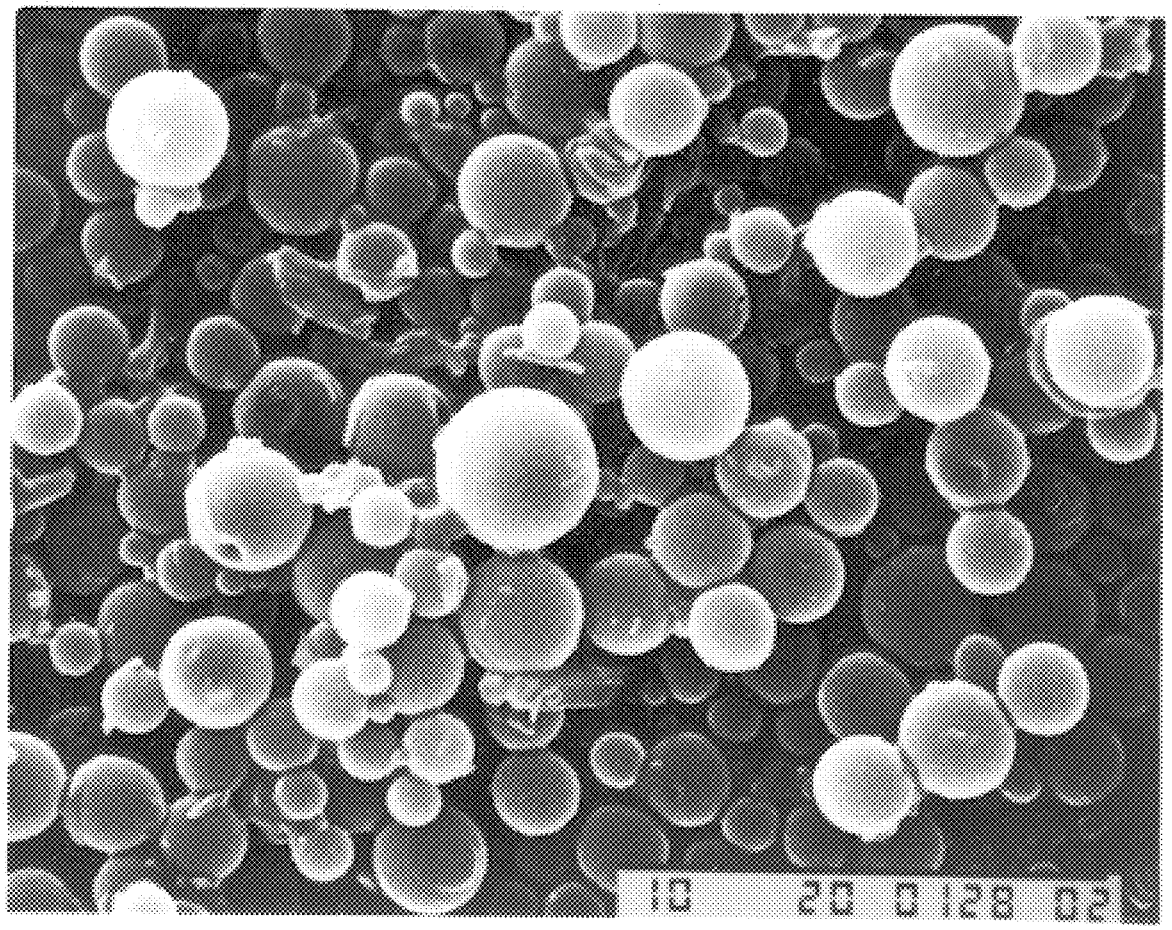
FIGURE 4 PRIOR ART
FIG. 4 is a photograph showing the construction of a polymer particle used in a conventional liquid developer.

FIG. 4 shows the polymer particles prepared by this method.

Comparative Example 2

The liquid developer obtained in Example 1 was forcibly mixed with an equal volume of glass beads (diameter: 5.0 mm), so as to deform the polymer particles dispersed in the developer to a flat configuration.

Comparative Example 3

The liquid developer was prepared by the same method as used in Example 1 with the exception that the Homomixer was operated at 15,000 rpm.

The obtained liquid developer was forcibly mixed with an equal volume of glass beads (diameter: 0.5 mm), so as to deform the polymer particles dispersed in the developer to a flat configuration.

Comparative Example 4

The liquid developer was prepared by the same method as used in Example 1 with the exception that the Homomixer was operated at 3,000 rpm.

The obtained liquid developer was forcibly mixed with an equal volume of glass beads (diameter: 1.0 mm), so as to deform the polymer particles dispersed in the developer to a flat configuration.

Table 1 shows mean volume particle size $d_{50}$ and degree of flatness of the polymer particles dispersed in the liquid developer in each of the previously described Examples 1~5 and Comparative Examples 1~4. The degree of flatness was expressed as the mean value of ten particle samples using the ratio of the longest diameter and shortest diameter measured by changing the angle of SEM observation of the polymer particles.

FIG. 3 is a photograph of the SEM image of polymer particles of Examples 1 and 2.

TABLE 1

| | Mixing speed (rpm) | Bead diameter (mm) | Restoration time (min) | $d_{50}$ ($\mu$m) | Flatness |
|---|---|---|---|---|---|
| Ex. 1 | 8,000 | 1.0 | — | 2 | 20 |
| Ex. 2 | 8,000 | 1.0 | 3 | 2 | 5 |
| Ex. 3 | 8,000 | 1.0 | 5 | 2 | 1.5 |
| Ex. 4 | 12,000 | 0.5 | — | 0.5 | 20 |
| Ex. 5 | 5,000 | 1.0 | — | 5 | 30 |
| Comp. 1 | 8,000 | 1.0 | 15 | 2 | 1.3 |
| Comp. 2 | 8,000 | 5.0 | — | 2 | 35 |
| Comp. 3 | 15,000 | 0.5 | — | 0.4 | 20 |
| Comp. 4 | 3,000 | 1.0 | — | 8 | 30 |

The liquid developer obtained in each of the Examples and Comparative Examples were evaluated for developing speed, transfer characteristics, printing resistance, and particle sedimentation (dispersion characteristics). The evaluation results are shown in Table 2.

Evaluations were made using the liquid developer image forming apparatus shown in FIG. 1.

In FIG. 1, reference numeral 1 refers to a photosensitive drum that is rotatable in the arrow direction. The surface of photosensitive drum 1 was uniformly charged to about −1,000 V by scorotron charger 3, and thereafter an electrostatic latent image was formed thereon by laser beam scanner 4. Reference numeral 20 refers to a developer bath which accommodated the various aforesaid liquid developers. Reference numeral 2 refers to a developing roller which receives the liquid developer supplied from developer bath 20. The aforesaid electrostatic latent image was rendered visible by development using the various liquid developers in developing region 8 disposed opposite developing roller 2. At this time, the rotational speed of photosensitive drum 1 was variable, and the rotational speed of developing roller 2 was adjusted top maintain a constant peripheral speed ratio with photosensitive drum 1 ($\theta$: rotational speed of developing roller/rotational speed of photosensitive drum) at $\theta$=10.

Thereafter, the excess liquid developer adhering to the surface of photosensitive drum 1 was removed by squeezing via squeeze roller 5, so as to form a toner image in a somewhat liquid state on the surface of photosensitive drum 1. When the toner image was directly transferred to transfer position 9 opposite transfer roller 6, said image was electrostatically transferred onto a paper sheet transported from another direction. At this time, a −1,000 V voltage was applied to transfer roller 6. After the transfer paper was separated from the surface of photosensitive drum 1, it was transported to a pair of heat fixing rollers 7 and subjected to fixing by heat and pressure, thereby completing the copy operation sequence.

Developing Speed

Using the previously described image forming apparatus, the speed of photosensitive drum 1 was varied, and a solid image output to measure the image density ID on the surface of photosensitive drum 1. The minimum limit of toner density (ID) at this time was standardized at ID=1.5. The maximum rotational speed of photosensitive drum 1 for obtaining this toner density ID was designated the maximum developing speed. The results were ranked in the manner described below; a ranking of Δ and higher was satisfactory. Toner density ID measurement was accomplished using a Sakura Densitometer PDA-65 (Konica K.K.).

◎: Maximum developing speed 500 mm/s or greater

○: Maximum developing greater than 200 mm/s, but less than 500 mm/s

Δ: Maximum developing speed greater than 50 mm/s, but less than 200 mm/s

X: Maximum developing speed less than 50 mm/s

Transfer Characteristics

Using the previously described image forming apparatus, a solid image was output and transferred to a transfer paper. Thereafter, the amount of developer adhering to the surface of the transfer paper and the amount of residual toner remaining adhered to the surface of photosensitive drum 1 were measured. Transfer efficiency was determined based on the following conditions. The results were ranked in the manner described below; a ranking of Δ and higher was satisfactory.

Transfer efficiency=(amount of developer adhered to surface of transfer paper)/(amount of developer adhered to surface of transfer paper+amount of residual developer)

◎: Transfer efficiency 95% or greater

○: Transfer efficiency greater than 80% but less than 90%

Δ: Transfer efficiency greater than 60% but less than 80%

X: Transfer efficiency less than 60%

Printing Resistance Characteristics

Using the previously described image forming apparatus, 1,000 sample images having a black-to-white (B/W) ratio of 5% were formed, and compared to the original solid images output previously. Image density ID was measured before and after the 1,000 sample image were made, and the rankings described below were made in accordance with the variations in image density ID. A ranking of Δ and higher posed no problem from a practical standpoint. The B/W ratio expresses the ratio of the black (image area) relative to white (paper surface).

◎: Change in image density less than 5%

○: Change in image density greater than 5% but less than 10%

Δ: Change in image density greater than 10% but less than 20%

X: Change in image density greater than 20%

Particle Sedimentation Characteristics

The density of the liquid developer changes when polymer particles settle, and changes in developer characteristics result in changes in the output image. Accordingly, the more resistant the polymer particles are to sedimentation, the more stable is image reproducibility. In general, the smaller the particle size, the slower the speed of sedimentation, and even with some amount of temporary sedimentation, simple mixing can return the developer to its original state.

In order to evaluate particle sedimentation characteristics, sedimentation acceleration tests were conducted using a centrifuge. The results were ranked in the manner described below; a ranking of Δ and higher Was satisfactory. Centrifugation was conducted at 5,000 rpm for 5 minutes.

◎: Amount of settled particles less than 20% by weight

○: Amount of settled particles greater than 20% but less than 40% by weight

Δ: Amount of settled particles greater than 40% but less than 60% by weight

X: Amount of settled particles greater than 60% by weight

TABLE 2

| | Developing speed | Transfer characteristics | Printing resistance | Sedimentation |
|---|---|---|---|---|
| Ex. 1 | ○ | ○ | Δ | ◎ |
| Ex. 2 | ○ | ○ | ○ | ○ |
| Ex. 3 | ○ | ○ | ○ | ◎ |
| Ex. 4 | Δ | Δ | ○ | ◎ |
| Ex. 5 | ◎ | ◎ | Δ | Δ |
| Comp. Ex. 1 | ○ | ○ | ○ | X |
| Comp. Ex. 2 | ○ | ○ | X | ◎ |
| Comp. Ex. 3 | X | X | ○ | ◎ |
| Comp. Ex. 4 | ◎ | ◎ | Δ | Δ |

As can be understood from Table 2, the liquid developer of the present invention provides excellent developing speed, transfer characteristics, printing resistance, and sedimentation characteristics.

Although the liquid developer of Comparative Example 4 exhibited the same rankings as the examples of the invention with regard to developing speed, transfer characteristics, printing resistance, and sedimentation characteristics, the polymer particles used had a mean volume particle size $d_{50}$ of 8 μm, such that high resolution images were unobtainable.

Furthermore, the shape of the polymer particles used in the liquid developer of the present invention is not limited to the round configurations shown in FIGS. 2 and 3 of the aforesaid examples wherein the shape of the polymer particles used in the liquid developer of the present invention had a degree of flatness greater than 1.5 but less than 30, inasmuch as long-slender needle-like polymer particles may be used.

What is claimed is:

1. A liquid developer for development of latent electrostatic images comprising flat configuration polymer particles within a dispersion medium, wherein the flat configuration polymer particles are prepared by deforming spherical polymer particles without distorting a mean volume particle size thereto, said flat configuration polymer particles have a mean volume particle size $d_{50}$ of 0.5~5.0 μm, 80% of the total volume of the flat configuration polymer particles being present within a range of $d_{50}$±1 μm, and degree of flatness is greater than 1.5 but less than 30, said flatness being the ratio of the longest diameter of a single particle to the shortest diameter of said single particle.

2. The liquid developer according to claim 1, wherein the dispersion medium is an electrically insulative organic material which is selected from the group consisting of aliphatic hydrocarbons, alicyclic hydrocarbons, aromatic hydrocarbons halogenated hydrocarbons, and polysiloxane.

3. The liquid developer according to claim 2, wherein the aliphatic hydrocarbons are isoparaffin hydrocarbons.

4. The liquid developer according to claim 2, wherein the polymer particles have the concentration of 0.5~50 percent by weight of the dispersion medium.

5. The liquid developer according to claim 1, wherein 80% of the total volume of the flat configuration polymer particles is present within a range of $d_{50}$±0.5 μm.

6. The liquid developer according to claim 1, wherein the flat configuration polymer particles comprise a resin selected from the group consisting of polyester resin, styrene-acrylic copolymer, polystyrene, polyvinyl chloride, polyvinyl acetate, polymethacrylate ester, polyester polyacrylic ester, epoxy resin, polyethylene, polyurethane, polyamide, and paraffin wax.

7. The liquid developer according to claim 1, wherein the flat configuration polymer particles contain pigments used for coloring.

8. The liquid developer according to claim 1 further comprising agents in the dispersion medium, the agents being enhancing agents or dispersion stabilizers.

9. The liquid developer according to claim 8, wherein the agents are selected from the group consisting of polyolefin petroleum resin, linseed oil, and polyalkylmethacrylate.

10. The liquid developer according to claim 8, wherein the agents have the concentration of 0.01~20 percent by weight of the dispersion medium.

11. The liquid developer according to claim 1, further comprising charge control agents in dispersion medium, the charge control agents being charge-regulating agents or charge enhancing agents.

12. The liquid developer according to claim 11, wherein the charge control agents have the concentration of 0.0001~10 percent by weight of dispersion medium.

13. The liquid developer according to claim 11, wherein the charge-regulating agents are selected from the group consisting of metal salts of fatty acids, metal salts of sulfosuccinate, metal salts of abietic acid, alkyd resins, lecithin, nitrogen compounds, and polyamide resins.

14. The liquid developer according to claim 11, wherein the charge enhancing agents are selected from the group consisting of $SiO_2$, $Al_2O_3$, TiO, and ZnO.

15. The liquid developer according to claim 1, wherein the flat configuration polymer particles are obtained by an emulsion dispersion granulation method, comprising the steps of:

preparing a polymer solution by dissolving a polymer structural resin in a non-water soluble organic solvent;

forming an oil-in-water (O/W) emulsion by dispersing the polymer solution in an aqueous dispersion solution;

obtaining polymer particles by heating the O/W emulsion while mixing so as to evaporate the organic solvent;

drying the polymer particles;

dispersing the dried polymer particles into the dispersion medium;

deforming the dispersed polymer particles, by heating the dispersion medium to a temperature near the glass transition point of said structural resin; and exerting stress on the dispersed polymer particles to produce the flat configuration polymer particles.

16. The liquid developer according to claim 15, wherein said stress is exerted on said polymer particles to produce said flat configuration polymer particles by adding an added medium to the dispersion medium, said added medium selected from the group consisting of glass beads, sand beads, zirconia beads, resin beads and resin-coated ferrite beads, and mixing the dispersion medium and the added medium.

17. The liquid developer according to claim 1, wherein the flat configuration polymer particles are obtained by spray drying method, comprising the steps of:

preparing a polymer solution by dissolving a polymeric structural resin in a non-water soluble organic solvent;

spraying said polymer solution into a drying chamber to obtain dried polymer particles;

dispersing the dried polymer particles into the dispersion medium;

deforming the dispersed polymer particles by heating the dispersion medium to a temperature near the glass transition point of said structural resin; and exerting stress on the dispersed polymer particles to produce the flat configuration polymer particles.

18. The liquid developer according to claim 17, wherein said stress is exerted on said polymer particles to produce said flat configuration polymer particles by adding an added medium to the dispersion medium, said added medium selected from the group consisting of glass beads, sand beads, zirconia beads, resin beads and resin-coated ferrite beads, and mixing the dispersion medium and the added medium.

19. A liquid developer for development of latent electrostatic images comprising flat configuration polymer particles within a dispersion medium, wherein the flat configuration polymer particles are prepared by stress exerted on spherical polymer particles without distorting a mean particle size thereto, said flat configuration polymer particles have a mean volume particle size $d_{50}$ of 0.5–3.0 $\mu$m, 80% of the total volume of the flat configuration polymer particles being present within a range of $d_{50}\pm1$ $\mu$m, and degree of flatness is greater than 1.5 but less than 30, said flatness being the ratio of the longest diameter of a single particle to the shortest diameter of said single particle.

20. A method of preparing a liquid developer for development of latent electrostatic images comprising polymer particles within a dispersion medium, said method comprising:

preparing a polymer solution by dissolving a polymeric structural resin in a non-water soluble organic solvent;

forming an oil-in-water (O/W) emulsion by dispersing the polymer solution in an aqueous dispersion solution;

obtaining polymer particles by heating the O/W emulsion while mixing so as to evaporate the organic solvent;

drying the polymer particles;

dispersing the dried polymer particles into the dispersion medium, said dispersed polymer particles having a mean volume particle size $d_{50}$ of 0.5~5.0 $\mu$m, 80% of the total volume of the dispersed polymer particles being present within a range of $d_{50}\pm1$ $\mu$m;

deforming the dispersed polymer particles, by heating the dispersion medium to a temperature near the glass transition point of the structural resin of the polymer particles;

exerting stress on the dispersed polymer particles to produce flat configuration polymer particles having a first degree of flatness greater than 1.5 but less than 30, said first degree of flatness being the ratio of the longest diameter of a single particle to the shortest diameter of said single particle, and having a mean volume particle size $d_{50}$ of 0.5~5.0 $\mu$m, 80% of the total volume of the flat configuration polymer particles being present within a range of $d_{50}\pm1$ $\mu$m;

controlling a shape of the flat configuration polymer particles by heating the flat configuration polymer particles at a temperature near the glass transition point of the structural resin of the polymer particles and thermally restoring the flat configuration polymer particles to a shape ranging from a spherical configuration to shapes of optional gradations without exerting stress on said polymer particles, said resulting heated polymer particles having a second degree of flatness greater than 1.5 but less than 30 said second degree of flatness being the ratio of the longest diameter of a single particle to the shortest diameter of said single particle, and having a mean volume particle size $d_{50}$ of 0.5~5.0 μm, 80% of the total volume of the resulting heated polymer particles being present within a range of $d_{50}$±1 μm.

21. A method of preparing a liquid developer for development of latent electrostatic images comprising polymer particles within a dispersion medium, said method comprising:

preparing a polymer solution by dissolving a polymeric structural resin in a non-water soluble organic solvent;

spraying said polymer solution into a drying chamber to obtain dried polymer particles;

dispersing the dried polymer particles into the dispersion medium;

deforming the dispersed polymer particles by heating the dispersion medium to a temperature near the glass transition point of the structural resin of the polymer particles;

exerting stress on the dispersed polymer particles to produce flat configuration polymer particles having a first degree of flatness greater than 1.5 but less than 30, said first degree of flatness being the ratio of the longest diameter of a single particle to the shortest diameter of said single particle, and having a mean volume particle size $d_{50}$ of 0.5~5.0 μm, 80% of the total volume of the flat configuration polymer particles being present within a range of $d_{50}$±1 μm;

controlling a shape of the flat configuration polymer particles by heating the flat configuration polymer particles at a temperature near the glass transition point of the structural resin of the polymer particles and thermally restoring the flat configuration polymer particles to a shape ranging from a spherical configuration to shapes of optional gradations without exerting stress on said polymer particles, said resulting heated polymer particles having a second degree of flatness greater than 1.5 but less than 30 said second degree of flatness being the ratio of the longest diameter of a single particle to the shortest diameter of said single particle, and having a mean volume particle size $d_{50}$ of 0.5~5.0 μm, 80% of the total volume of the resulting heated polymer particles being present within a range of $d_{50}$±1 μm.

* * * * *

UNITED STATES PATENT AND TRADEMARK OFFICE

CERTIFICATE OF CORRECTION

PATENT NO. : 5,958,643

DATED : September 28, 1999

INVENTOR(S) : Fujiwara et al.

It is certified that error appears in the above-identified patent and that said Letters Patent is hereby corrected as shown below:

Claim 15, line 5, change "polymer" (2nd occurrence) to --polymeric--.

Signed and Sealed this

Eighth Day of August, 2000

*Attest:*

*Attesting Officer*

Q. TODD DICKINSON

*Director of Patents and Trademarks*